United States Patent [19]

Heidorn et al.

[11] 3,982,801

[45] Sept. 28, 1976

[54] POWER-OPERATING VERTICALLY ADJUSTABLE CANTILEVER SHELVES FOR APPLIANCE CABINETS

[75] Inventors: John H. Heidorn; James A. Bernard, both of Dayton, Ohio

[73] Assignee: General Motors Corporation, Detroit, Mich.

[22] Filed: Nov. 17, 1975

[21] Appl. No.: 632,293

[52] U.S. Cl. ..... 312/306; 108/147; 62/132; 312/312

[51] Int. Cl.[2] ..... F25B 49/00; F16M 1/00

[58] Field of Search ..... 312/306, 311, 312; 248/11; 108/141, 147; 62/132, 264, 2

[56] References Cited

UNITED STATES PATENTS

| | | | |
|---|---|---|---|
| 2,737,781 | 3/1956 | Gelfand | 312/312 |
| 3,063,775 | 11/1962 | Snowman | 108/141 |
| 3,360,322 | 12/1967 | Hanifan | 312/312 |
| 3,572,049 | 3/1971 | Moorman | 62/132 |
| 3,774,872 | 11/1973 | Morelli | 248/11 |

*Primary Examiner*—Casmir A. Nunberg
*Attorney, Agent, or Firm*—Edward P. Barthel

[57] ABSTRACT

A power-operated vertically adjustable shelf is supported by shelf arms in cantilevered fashion at the rear of an appliance cabinet by a gear and roller on each shelf arm, with each gear and roller vertically offset engaging a vertically extending toothed rack and a roller track. Electric drive means, carried by the cabinet, powers a vertically extending drive shaft of which the torque is transmitted to the shelf operating gear through a normally disengaged clutch which is engaged by user operating means adjacent the front of each shelf whereby powered vertical movement of the shelves is achieved. A dual position selector shelf switch is operable upon opening the door to permit the user to select up or down power shelf movement with the shelf switch being neutralized upon closing of the cabinet door.

4 Claims, 7 Drawing Figures

POWER-OPERATING VERTICALLY ADJUSTABLE CANTILEVER SHELVES FOR APPLIANCE CABINETS

This invention relates to vertically adjustable appliance cabinet shelves and more particularly to a power-operated cantilever supported shelf arrangement in the storage compartment thereof.

The prior art is replete with vertically adjustable cabinet shelves such as those found in the food storage compartment of household refrigerators. One example of a vertical adjustable refrigerator shelf is found in U.S. Pat. No. 2,841,459 issued July 1, 1958 to V. G. Sharp and assigned to the asssignee of the instant application. The present invention is directed to power operated adjustable shelves for refrigerator cabinets or the like wherein each shelf is supported in a cantilever manner to provide for quick and easy adjustment by the user both upwardly and downwardly from one horizontal plane to another within the refrigerator food storage compartment by means of touch-control actuating means conveniently located on each shelf adjacent the front thereof. It is therefore an object of the present invention to provide means for vertically adjusting power-operated shelves in an appliance compartment relative to one another that is simple to operate and readily accessible to the user without requiring major modification or alteration of the appliance.

Another object of the present invention is to provide a plurality of power operating adjustable shelves that are supported in cantilever fashion from spaced vertical stringer members located on the rear wall of a refrigerator compartment and are powered by reversible electric drive means which rotate a vertically extending drive shaft of which the torque is transmitted to shelf rack and pinion gear means through a normally disengaged clutch associated with each shelf which is selectively engaged by user operating means adjacent the front of each shelf, and wherein the clutches provide overload slippage cutout in the event of an overload on the shelf.

It is still another object of the present invention to provide a novel adjustable shelf switching means for a power operated refrigerator cabinet shelf having first and second operating positions, and a pair of user selectable actuator means extending from the cabinet, the first actuator means causing the electric motor to run clockwise, and the second actuator means causing the electric motor to run counterclockwise, and wherein the switch has a third position operable by the compartment door adjacent edge such that when the door closes the pair of actuator means are engaged by the door edge wherein the switch contacts for the first and second operating positions are opened placing said switch in a neutral off position.

These and other objects of the present invention will become apparent from the following description, reference being had to the accompanying drawings wherein a preferred embodiment of the present invention is clearly shown.

In the Drawings

Figures 4, 5, 6, 7:
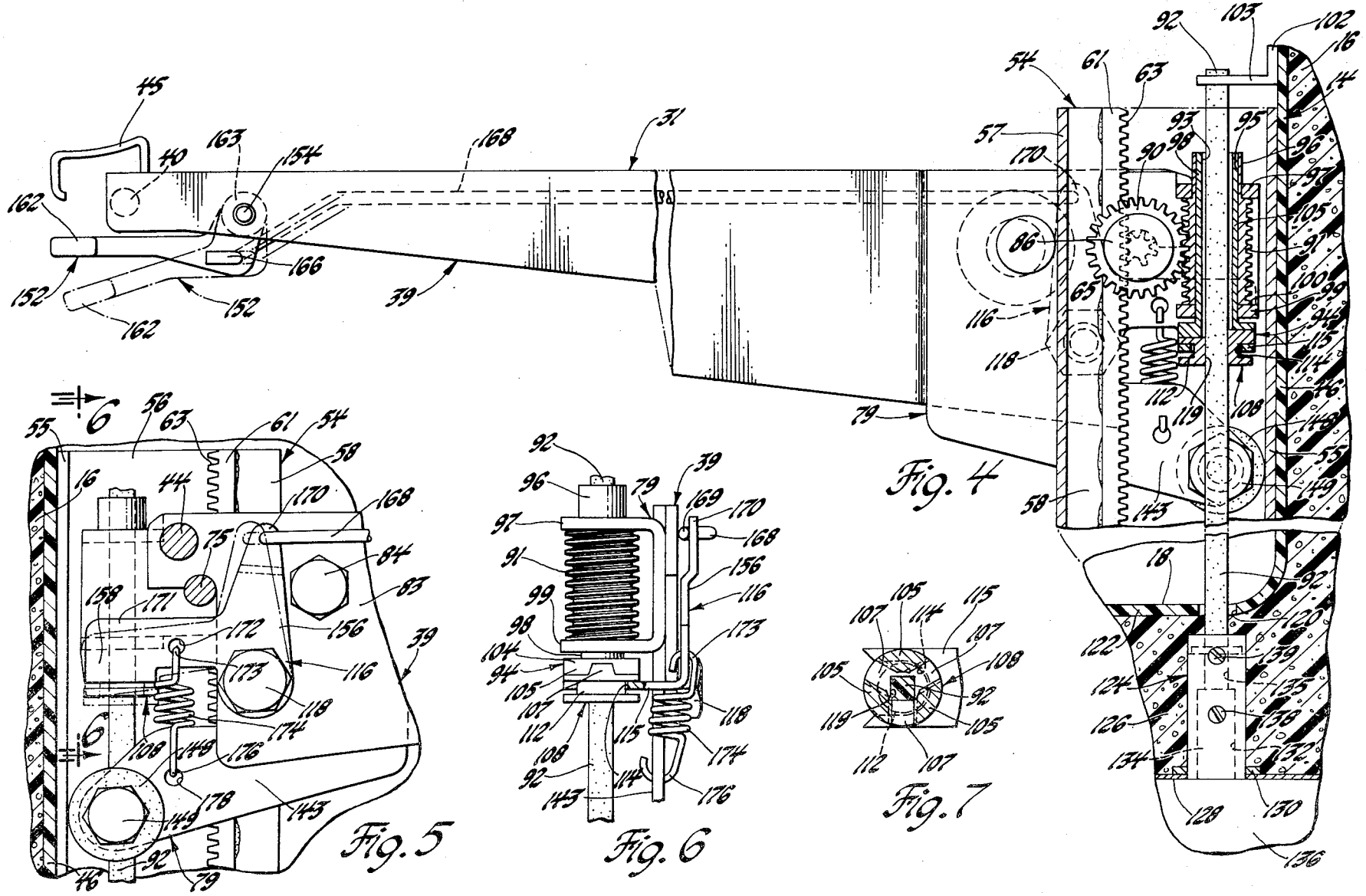
FIG. 4 is a broken fragmentary vertical sectional view taken on the line 4—4 of FIG. 3, showing a rack and pinion means in the roller associated therewith in the food compartment for a vertically adjustable power shelf.
FIG. 5 is an enlarged fragmentary view of the clutch arrangement control means of FIG. 3.

FIG. 6 is a side view of the worm gear and clutch arrangement shown in FIGS. 4 and 5, taken on line 6—6 of FIG. 5; and FIG. 7 is a sectional view taken on line 7—7 of FIG. 6.

Figure 1:
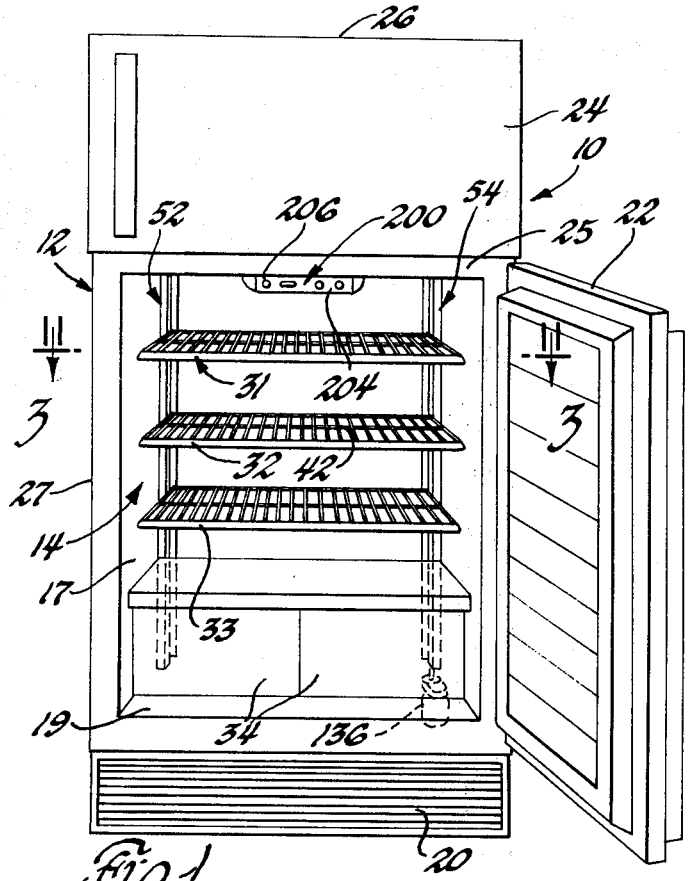
FIG. 1 is a front view of a refrigerator cabinet, having the disclosed shelf arrangement in the food storage compartment, with the compartment door open.
Figure 3:
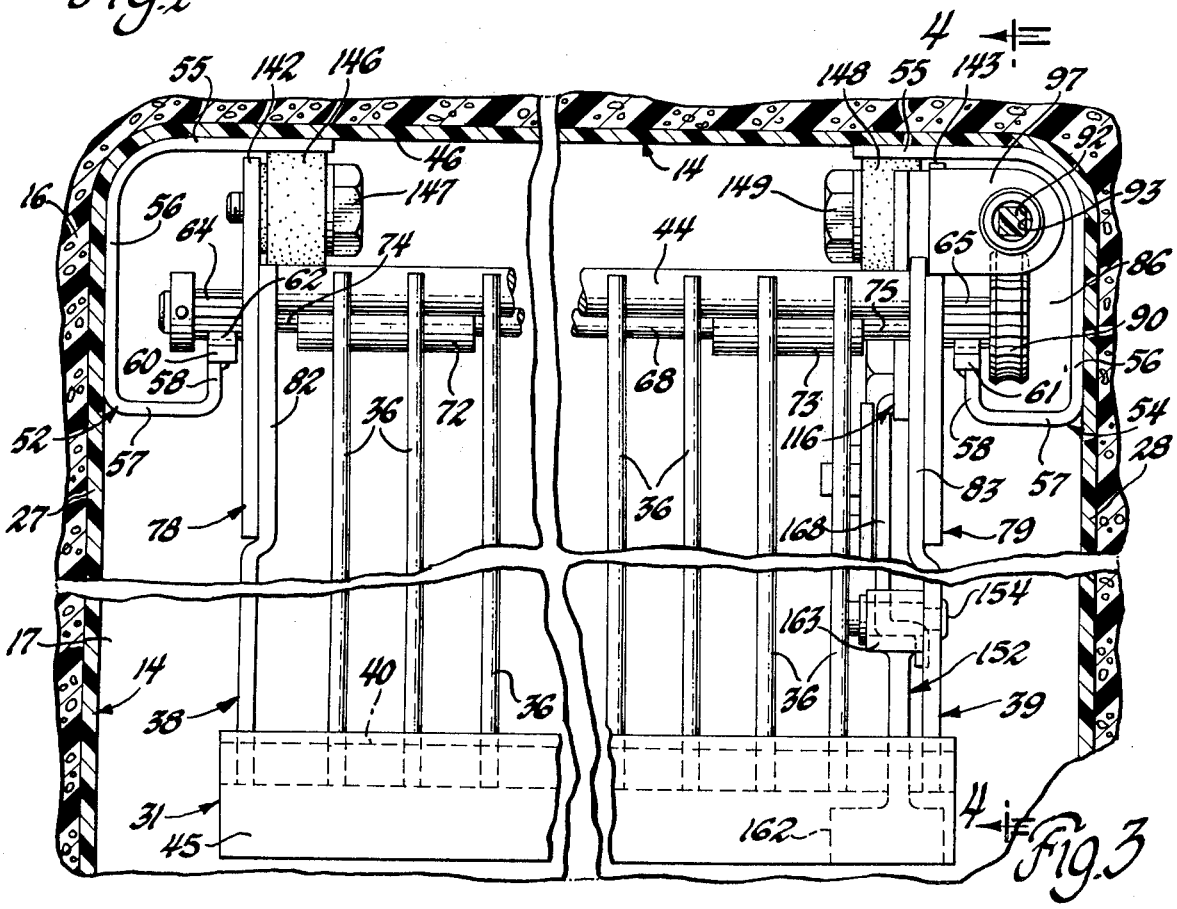
FIG. 3 is an enlarged broken fragmentary horizontal section view taken on the line 3—3 of FIG. 1 of the vertically adjustable shelf supported in a cantilever fashion in the food compartment of a refrigerator.

Referring to the drawings, for illustrating my invention, I show in FIG. 1 thereof a household refrigerator 10 of rectilinear configuration comprising an outer metal shell 12, an inner liner 14, preferably molded of plastic, with any suitable insulating material 16, such as foamed-in-place urethane for example, disposed therebetween (see FIG. 3). The insulated wall structure forms or defines the top, bottom and upright back and side walls of a food storage compartment 17 within the refrigerator cabinet. Compartment 17 may be cooled by an evaporator of a conventional closed refrigeration system such as shown for example in U.S. Pat. No. 3,572,049 issued Mar. 23, 1971 to E. J. Moorman and assigned to the assignee of the present application the disclosure of which is incorporated by reference herein. The evaporator of the refrigerating system compartment is located in the machinery compartment positioned below an upper offset portion 18 (FIG. 4) of insulated bottom wall 19 which separates the compartment from the machinery compartment the forward portion of which is closed by a front decorative panel 20.

The fresh food compartment 17 has a front access opening normally closed by lower insulated door structure 22, shown in open position in FIG. 1, hingedly mounted on the refrigerator cabinet while an upper door 24 is shown closing an upper freezer compartment of the cabinet. The upper below-freezing compartment is separated from the lower above-freezing compartment by an insulated partition the front edge of which is indicated at 25. The cabinet includes an insulated top outer wall 26, insulated side walls 27 and 28, the inner surfaces of which extend rearwardly from the cabinet front opening, and having disposed therebetween in the lower compartment 17 a plurality of spaced apart shelves 31, 32 and 33 on which articles can be stored and lower storage bins 34 located above compartment insulated bottom wall 19.

Shelves 31, 32 and 33, insofar as the present invention is concerned, are preferably constructed of metal rods 36 although other forms of shelves, such as reticulated shelves stamped from sheet metal or shelves molded of plastic, could be used. In the disclosed form the shelves 31, 32 and 33 are mounted in a cantilevered manner by means of a pair of cantilever shelf support arm members 38 and 39 in the form of wedge-shaped plates suitably fastened, as by welding, to the opposite ends of the crossbars 40, 42 and 44 and metal front edge gripping member 45 as seen in FIGS. 1 and 3.

As best seen in FIG. 3, the cabinet liner includes a rear wall 46 with a pair of shelf supporting elongated structural stringer members, generally indicated at 52 and 54, which in the disclosed embodiment are positioned vertically in any suitable manner at the rear wall.

In the disclosed form the stringers are shown positioned at each vertically extending rear corner of the cabinet. As the stringer members 52, 54 are mirror images of each other, the same numerals will be used in the following description of certain of their components. Thus each stringer is generally right angle-shaped in horizontal cross section providing two normal leg flanges 55 and 56 with the side wall leg flange 56 having an inwardly directed web flange or bight portion 57 terminating in a return flange 58 positioned at 90 degrees to the bight portion 57. The inwardly directed edges of each return flange 58 include rack means 60 and 61 included therewith having teeth 62 and 63, respectively, which teeth extend substantially the full height of the stringers.

As seen in FIGS. 3–5 pinion gears 64 and 65, meshed with the rack teeth 62 and 63 respectively, are supported adjacent the ends of transverse rotatable shaft 68 by means of sleeve couplers 72 and 73 telescoped on each side of the shaft 68 and fixedly secured thereto with left 74 and right 75 journal shaft portions. Each of the pinion gear shaft portions are telescoped in the outer ends of their respective sleeve couplers 72 and 73 and suitably secured as by set screws (not shown). Shaft portions 74 and 75 are rotatably supported in their shelf arm members 38 and 39 by extending through apertures therein aligned with apertures provided in side gusset plates 78 and 79, which plates are suitably secured at the rear offset portions 82, 83 respectively, of the shelf support arm members 38 and 39 as by bolts indicated at 84 in FIG. 5. It will be appreciated that while the plates 78 and 79 are shown as separate members it will be understood that they could be integral with their associated arm members 38 and 39.

As seen in FIG. 4, an integral hub 86 extends axially from a compound or cluster pinion gear 65 and wheel gear 90 with the latter positioned to mesh with and be driven by a vertically extending worm gear 91. As seen in FIG. 4 a vertically extending drive shaft 92 has a substantially square cross section of a size adapted to be freely rotatable within a circular bore 93 of upper clutch member 94, which clutch bore 93 is formed within a tubular socket 98 of the clutch member 94 press fitted within the worm bore 95. The combination worm gear 91 and clutch member 94 is supported for rotation by virtue of worm upper hub 96 rotatably journaled in an aperture of an upper, horizontally disposed flange 97 while the lower portion of clutch socket 98 is rotatably journaled in an aligned aperture in the lower horizontal flange 99. The upper extremity of square sectioned shaft 92 is rotatably held by support means, such as by angle bracket 102 suitably affixed to the liner 14, with its horizontal leg 103 having a circular opening aligned with clutch bore 93 to rotatably receive shaft 92. In the form shown the flanges 97 and 99 are lanced from the gusset plate 79 and bent at right angles thereto.

It will be noted that in the preferred form the shaft 92 is formed from epoxy resin impregnated glass laminate which allows it to deform or bow under certain load conditions. Applicants' use of a flexible plastic drive shaft 92 solved the problem inherent in steel drive shafts which on occasion, such as an overloaded shelf, developed a permanent bow or set resulting in possible binding of the shelf drive mechanism.

As viewed in FIGS. 6 and 7, the clutch member 94 includes an upper first clutch element 104 having formed thereon a series of teeth 105 for cooperation with correspondingly shaped teeth 107 on a second lower driving clutch element 108. As seen for teeth 107 (FIG. 7) the clutch teeth 105 and 107 are preferably in the form of three, 120° spaced, generally triangular shaped teeth in plan, separated by three radially extending flat bottomed grooves 110 also spaced on 120° radial centers. Applicants' clutch teeth provide for long life while enabling the drive teeth 107 to slip or release relative to the driven teeth 105 under shelf overload conditions to prevent damage to the components.

As seen in FIGS. 4–6 the lower clutch element 108 has a circumferential rectangular sectioned groove 112 dimensioned to be received in the open end of slot 114 formed in horizontal leg flange 115 of a rear bellcrank lever, generally indicated at 116. As seen in FIG. 5 the lever 116 is pivotally mounted on the inner surface of the rear offset portion 83 of shelf arm member 39 by means of pivot stud or bolt 118. The actuating means for lower clutch element 108 will be discussed subsequently.

With reference to FIG. 7, it will be seen that the lower clutch element 108 is formed with a rectangular central aperture 119 adapted to slidably receive the vertical drive shaft 92 therethrough. By virtue of this arrangement the lower clutch element 108 is keyed to the drive shaft 92 to rotate therewith. To this end the slot 114 has a radiused inner portion 114' conforming to the base of slot 114 so that clutch element 108 is journaled in slot 114 in coaxial relation to the upper clutch element 106.

As shown in FIGS. 1 and 4, the vertically extending drive shaft 92 has its lower end extending through aperture 120 in the liner bottom wall 122 for engagement with a coaxial tubular sleeve coupling or connector 124 shown located within the bottom wall foam insulation 126. The lower end of the sleeve coupling 124 is secured to the bottom wall metal shell 128 by connector flange ring 130 and extends through an aperture in shell 128 such that connector lower counterbore 132 telescopically receives the upper end of output shaft 134 of electric drive motor 136 which is suitably mounted in the refrigerator machinery compartment. Securing means such as lower set screw 138 secures the motor shaft 134 within counterbore 132 while securing means, such as upper set screw 139, fixedly retain the lower end of the shaft 92 in the rectangular sectioned bore 135 of the coupling. One example of a coupling suitable for use between the motor 136 and shaft 92 is referred to as a Boston FA Coupling.

As seen in FIG. 3, each of the shelf arm plate members 78 and 79 include rearwardly extending integral lobe-shaped brackets 142 and 143 respectively, on each of which are rotatably mounted roller means in the form of wheel members operative for providing tracking engagement with the rear wall portion of the cabinet. The lefthand roller means in the preferred form is roller 146 shown carried on the inner side of bracket 142 by stationary fixed studs or the like such as bolt 147 secured to the bracket with the roller revolvable thereon. The righthand roller 148 is similarly journaled or revolvable on bolt 149. In the disclosed form the stringer rear leg flanges 55 and 56 provide vertically disposed metal tracking surfaces serving as load beds for the rollers 146 and 148. Thus, it will be seen in FIG. 3 that applicant's arrangement of having the axes of rollers 146 and 148 located in horizontally rearward offset relation to the axes of their associated pinions 64 and 65 respectively, and disposed a predetermined vertical distance therebelow; a force couple is provided, each of the reactions being taken up by their associated stringer members 52 and 54. The rollers 146 and 148 are preferably molded of plastic material providing a smooth, friction-reducing contact with the tracking surfaces of the stringers.

As best seen in FIG. 4, the righthand shelf arm member 39 includes clutch actuuating or engaging mechanism including a pair of bellcrank lever members in the form of outer or forward lever 152 and inner or rearward lever 79 both being pivotally mounted on the inside of shelf arm member 39 on studs or the like 154 and 118 respectively, the studs being fixedly mounted on the arm member 39. The rearward bellcrank lever 116 is provided with an upwardly extending arm portion 156 and with a rearwardly extending arm portion 158 while the forward bellcrank lever 152 has an outwardly extending actuating arm or handle portion 162 and an upwardly extending arm portion 163. The lever arm portion 163 is bored to receive stud 154 while an aperture is provided intermediate its ends for receiving the outwardly turned end 166 of connecting rod 168.

As seen in FIG. 6, inwardly turned inner end 169 of connecting rod 168 is received in an aperture in the upwardly extending offset portion 170 of bellcrank lever 116. The bellcrank rearwardly extending leg portion 171 has an aperture 172 for reception of one hooked end 173 (FIG. 6) of resilient biasing means in the form of coil tension spring 174, while its opposite hooked end 176 extends through a hole 178 in the bracket 143. Thus, the coil spring 174 acts to bias the rearward or second bellcrank lever 116 into its phantom line position shown in FIG. 5 and via the connecting rod 168 bias the first or forward bellcrank lever 152 into its lower phantom line position shown in FIG. 4.

Figure 2:
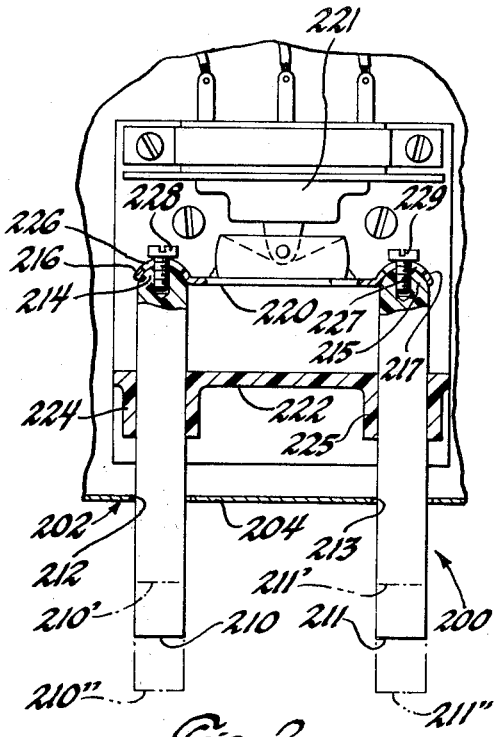
FIG. 2 is a partially schematic view, partly in section, of the power shelf control switch arrangement.

The power adjustable shelf in the preferred form is operated by a control device or shelf actuating mechanism, indicated generally by reference character 200 in FIG. 2, located in a known refrigerator control assembly having a housing 202 fastened to and mounted on the bottom of the refrigerator cabinet horizontally disposed dividing partition means 25, the details of which are shown in U.S. Pat. No. 3,572,049 issued Mar. 23, 1971 to Moorman and assigned to the assignee of the present application. As disclosed in the Moorman patent the housing 202 includes cabinet lighting means operated by a door switch (not shown) while the front panel 204 of the housing 202 is provided with an opening through which projects a pushbutton extension 206 of a cabinet light switch shown in the mentioned Moorman patent. The pushbutton extension 206 is adapted to be engaged by an adjacent portion of the lower fresh food compartment door 22.

Applicant's shelf actuating mechanism includes a pair of pushbutton extension rods or plungers 210 and 211 spaced from one another and slidably mounted in apertures 212 and 213 respectively of the housing panel 204. The inner rounded ends 214 and 215 respectively, of the plungers 210, 211 are disposed tp engage or set in cup-shaped recesses 216 and 217 of three position rocker 220 of a rocker-actuated electric slide switch 221. A guide frame 222 formed with apertured boss members 224 and 225 throuogh which the plungers 210 and 211 extend for axial travel while slotted openings 226 and 227 in the respective cups 216 and 217 allow securing screws 228 and 229 to move relative to the rocker 220. One such rocker switch is commercially available from the Stackpole Components Company which is disclosed in their U.S. Pat. No. 3,217,112 to Campbell et al., issued Nov. 9, 1965.

In the preferred form the plunger 210 initiates the downward movement of the shelves and the plunger 211 the upward movement of the shelves. That is when the plunger 210 is depressed or moved to its inner dotted line position 210' the switch 220 completes a circuit through the reversible motor 136 to drive shaft 92 in a first counterclockwise direction, while upon plunger 211 being depressed to its dotted line position 211' the switch 220 completes a circuit through the motor 136 to rotate shaft 92 in a second clockwise direction. It will be appreciated that if either plunger is in its actuated depressed position that upon the closing of the door 22 the remaining plunger, being in its outer extended dotted line posiion 210'' or 211'', will be engaged by the door inner panel causing the rocker 220 to center the switch slide 222 and moving the plungers to their full line position deenergizing the drive motor 136. Thus, the motor will be deenergized upon either the "UP" plunger 211 or the "DOWN" plunger 210 being in its outer dashed line position when the operator closes the door 22.

In operation, when it is desired to adjust a shelf, such as shelf 31, upwardly or downwardly relative to another shelf in compartment 17 to vary its height therein, the cabinet door 22 is opened and the appropriate plunger 210 or 211 is depressed by the operator. In the case of lowering shelf 31, for example, the "DOWN" plunger 211 is depressed causing the motor 136 to rotate shaft 92 and lower clultch element 108 in a counterclockwise direction. The operator raises the handle 162 of shelf 31 to its full line position thus pivoting rear bellcrank 116 to its full line position of FIG. 5 causing the lower clutch element 108 to engage or mesh with the upper clutch element 94 to drive worm gear 91 and thereby rotating wheel gear 90 in a clockwse direction as viewed in FIG. 4. The rotation of wheel gear 90 drives both pinion gears 64 and 65 in a first clockwise direction on racks 60 and 61, causing shelf 31 to be individually lowered relative to the remaining shelves 32 and 33. In a similar manner the shelves 32 and 33 may be individually raised and lowered in the food compartment without removing the same from the food compartment, without disassembling any parts of the structure and while food products are supported on the shelf.

While the embodiment of the present invention constitutes a preferred form, it is to be understood that other forms might be adopted.

We claim:

1. In a refrigerator cabinet or the like having a plurality of walls including a rear wall defining a storage compartment and an access opening thereto, a shelf adjustor mechanism for vertically moving a shelf within said compartment, said mechanism comprising a pair of vertical stringers secured to said rear wall, each said stringer having a vertically extending series of ratchet teeth formed on a rearwardly facing surface thereof, driven shaft means disposed transversely on said shelf adjacent the rearward portion thereof having a pair of driven gears thereon, each driven gear in meshed engagement with one of said stringer ratchet teeth, a pair of shelf roller means pivotally supported on a common transverse axis offset rearwardly and below said shelf driven shaft means whereby each said roller means tracks on a forwardly facing stringer surface, drive means for said mechanism including a drive shaft coupled to a reversible drive motor extending vertically adjacent the rear wall, gear means associated with said shelf through which said shelf driven shaft means is rotated, clutch means for connecting said drive shaft with said shelf gear means operable to rotate said shelf driven shaft means in either direction, manually operable selectable switch means enabling the user to energize said motor to rotate said drive shaft in one or another direction, and user operating means on said shelf for actuating said clutch means into engagement; whereby upon the user first actuating said switch means to a selected position, depending upon whether it is desired to raise or lower said shelf, and thereafter the user actuating said shelf operating means to engage said clutch means said shelf is moved vertically to the desired location.

2. In a refrigerator cabinet or the like having a plurality of walls including a rear wall defining a storage compartment and an access opening thereto, a shelf adjustor mechanism for vertically moving a shelf within said compartment, said mechanism comprising a pair of vertical stringers secured to said rear wall, each said stringer having a vertically extending series of ratchet teeth formed on a rearwardly facing surface thereof, driven shaft means disposed transversely on said shelf adjacent the rearward portion thereof having a pair of driven pinion gears and a worm wheel gear thereon, each said driven gear in meshed engagement with one of said stringer ratchet teeth, a pair of shelf roller means pivotally supported on a common transverse axis offset rearwardly and below said shelf driven shaft mens whereby each said roller mans tracks on a forwardly facing stringer surface, drive means for said mechanism including a drive shaft coupled to a reversible drive motor extending vertically adjacent the rear wall, gear means associated with said shelf through which said shelf driven shaft means is rotated, and gear means including a vertically extending drive worm meshed with said worm wheel gear, having a bore through which said drive shaft extends, clutch means for connecting said drive shaft with said shelf gear means operable to rotate said shelf driven shaft means in either direction, said clutch means including a first clutch element fixed on the lower end of said drive worm and a second clutch element disposed on said drive shaft for rotation therewith, manually operable selectable switch means enabling the user to energize said motor to rotate said drive shaft in one or another direction, user operating means on said shelf adapted to axially move said second clutch element into engagement with said first clutch element, whereby upon the user first actuating said switch means to a selected position, depending upon whether it is desired to raise or lower said shelf, and thereafter the user actuating said shelf operating means to engage said clutch means said shelf is moved vertically to a desired location.

3. In a refrigerator cabinet or the like having a plurality of walls including a rear wall defining a storage compartment and an access opening thereto, shelf adjustor mechanism for vertically moving a plurality of cantilevered shelves within said compartment, said mechanism comprising a pair of vertical stringers secured to said rear wall, each said stringer having a vertically extending series of ratchet teeth formed on a rearwardly facing surface thereof, driven shaft means disposed transversely on each of the shelves adjacent the rearward portion thereof having a pair of driven gears thereon, each said driven gear in meshed engagement with one of said stringer ratchet teeth, a pair of shelf roller means pivotally supported on each of the shelves on a common transverse axis offset rearwardly and below the shelf driven shaft means whereby each of the roller means tracks on its adjacent forwardly facing stringer surface, drive means for said mechanism including a drive shaft coupled to a reversible drive motor, said drive shaft extending vertically adjacent the rear wall, rear means associated with each of the shelves through which each of the shelf driven shaft means are rotated, clutch means associated with each of the shelves for connecting said drive shaft with each shelf gear means operable to selectively rotate its shelf driven shaft means in one or another direction, manually operable selectable switch means mounted on the cabinet enabling the user to energize said motor to rotate said drive shaft in one or another direction, and user operating means on each of the shelves for actuating its associated clutch means into engagement; whereby upon the user first actuating said switch means to a selected position, depending upon whether it is desired to raise or lower a shelf, and thereafter the user actuating one of the shelf operating means to engage its clutch means the selected shelf is moved vertically to the desired location.

4. In a refrigerator storage cabinet having a top, bottom, rear and opposed side walls having an access opening thereto closed by a door, a shelf adjustor mechanism for vertically moving a cantilevered shelf within said compartment, said mechanism comprising a pair of vertical stringers secured to said rear wall, each said stringer having a vertically extending series of ratchet teeth formed on a rearwardly facing surface thereof, driven shaft means disposed transversely on said shelf adjacent the rearward portion thereof having a pair of driven gears thereon, each said driven gear in meshed engagement with one of said stringer ratchet teeth, a pair of shelf rollers pivotally supported on a common transverse axis offset rearwardly and below said shelf driven shaft means whereby each said roller means tracks on its adjacent forwardly facing stinger surface, drive means for said mechanism including a drive shaft coupled to a reversible drive motor extending veritcally adjacent a rear corner of the cabinet, gear means associated with said shelf through which said shelf driven shaft means is rotated, clutch means for connecting said drive shaft with said shelf gear means operable to rotate said shelf driven shaft means in either direction, manually operable selectable switch means, said switch means including a pair of plungers operating a three position motor energizing switch, said plungers positioned on said cabinet enabling the user to energize said motor to rotate said drive shaft in one or another direction depending upon which plunger is depressed, such that if either plunger is in its actuated depressed position the remaining plunger will be moved to an outer extended position, whereby upon the closing of said door the extended plunger will be engaged by the door inner panel causing the switch to be moved to its neutral motor deenergizing position, and user operating means on said shelf for actuating said clutch means into engagement; whereby upon the user first actuating one of said switch plungers to a selected position, depending upon whether it is desired to raise or lower said shelf, and thereafter the user actuating said shelf operating means to engage said clutch means said shelf is moved vertically to the desired location.

* * * * *

UNITED STATES PATENT AND TRADEMARK OFFICE

CERTIFICATE OF CORRECTION

PATENT NO. : 3,982,801

DATED : September 28, 1976

INVENTOR(S) : John H. Heidorn and James A. Bernard

It is certified that error appears in the above-identified patent and that said Letters Patent are hereby corrected as shown below:

| | |
|---|---|
| Col. 3, line 67 -- driven --. | after "first" insert |
| Col. 5, line 63 read -- through --. | "throuogh" should |
| Col. 6, line 17 read -- position --; | "posiion" should |
| line 63 - Claim 1 "each" insert -- said --. | line 10) after |
| Col. 7, line 33 - Claim 2 should read -- means --; | line 14) "mens" |
| same line -- means --; | "mans" should read |
| Col. 7, line 38 - Claim 2 should read -- said --. | line 18) "and" |
| Col. 8, line 9 - Claim 3 should read -- gear --; | "rear" |
| line 40 - Claim 4 should read -- stringer --; | line 14) "stinger" |
| line 43 - Claim 4 should read -- vertically --. | "veritcally" |

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*